US007293599B2

(12) United States Patent
Peker et al.

(10) Patent No.: US 7,293,599 B2
(45) Date of Patent: Nov. 13, 2007

(54) INVESTMENT CASTING OF BULK-SOLIDIFYING AMORPHOUS ALLOYS

(75) Inventors: Atakan Peker, Aliso Viejo, CA (US); Choongnyun Paul Kim, Northridge, CA (US)

(73) Assignee: Liquidmetal Technologies, Inc., Lake Forest, CA (US)

( * ) Notice: Subject to any disclaimer, the term of this patent is extended or adjusted under 35 U.S.C. 154(b) by 10 days.

(21) Appl. No.: 10/529,585

(22) PCT Filed: Sep. 30, 2003

(86) PCT No.: PCT/US03/31156

§ 371 (c)(1),
(2), (4) Date: Mar. 29, 2005

(87) PCT Pub. No.: WO2004/030848

PCT Pub. Date: Apr. 15, 2004

(65) Prior Publication Data

US 2006/0086476 A1 Apr. 27, 2006

Related U.S. Application Data

(60) Provisional application No. 60/415,149, filed on Sep. 30, 2002.

(51) Int. Cl.
*B22C 9/04* (2006.01)
*B22D 27/04* (2006.01)

(52) U.S. Cl. ..... 164/516; 164/122

(58) Field of Classification Search ..... 164/516–519, 164/122

See application file for complete search history.

(56) References Cited

U.S. PATENT DOCUMENTS

| | | | |
|---|---|---|---|
| 2,190,611 | A | 2/1940 | Sembdner |
| 4,115,682 | A | 9/1978 | Kavesh et al. |
| 4,289,009 | A | 9/1981 | Festag et al. |
| 4,472,955 | A | 9/1984 | Nakamura et al. |
| 4,529,457 | A | 7/1985 | Kushnick |
| 4,621,031 | A | 11/1986 | Scruggs |
| 4,710,235 | A | 12/1987 | Scruggs |
| 4,854,370 | A | 8/1989 | Nakamura |
| 4,990,198 | A | 2/1991 | Masumoto et al. |
| 5,032,196 | A | 7/1991 | Masumoto et al. |
| 5,053,084 | A | 10/1991 | Masumoto et al. |

(Continued)

FOREIGN PATENT DOCUMENTS

EP 0494688 B1 7/1992

(Continued)

OTHER PUBLICATIONS

Amiya et al., "Mechanical Strength and Thermal Stability of Ti-Based Amorphous Alloys with Large Glass-Forming Ability", 1994, Materials Science and Engineering, A179/A180, pp. 692-696.

(Continued)

*Primary Examiner*—Kuang Lin
(74) *Attorney, Agent, or Firm*—Kauth, Pomeroy, Peck & Bailey LLP

(57) ABSTRACT

A method of investment casting bulk-solidifying amorphous alloys, and the formation of articles of bulk-solidifying amorphous alloys made by such methods are provided.

15 Claims, 6 Drawing Sheets

U.S. PATENT DOCUMENTS

| | | | | |
|---|---|---|---|---|
| 5,053,085 | A | 10/1991 | Masumoto et al. | |
| 5,074,935 | A | 12/1991 | Masumoto et al. | |
| 5,117,894 | A | 6/1992 | Katahira | |
| 5,131,279 | A | 7/1992 | Lang et al. | |
| 5,169,282 | A | 12/1992 | Ueda et al. | |
| 5,225,004 | A | 7/1993 | O'Handley et al. | |
| 5,288,344 | A | 2/1994 | Peker et al. | |
| 5,296,059 | A | 3/1994 | Masumoto et al. | |
| 5,306,463 | A | 4/1994 | Horimura | |
| 5,312,495 | A | 5/1994 | Masumoto et al. | |
| 5,324,368 | A | 6/1994 | Masumoto et al. | |
| 5,368,659 | A | 11/1994 | Peker et al. | |
| 5,390,724 | A | 2/1995 | Yamauchi et al. | |
| 5,564,994 | A | 10/1996 | Chang | |
| 5,567,251 | A | 10/1996 | Peker et al. | |
| 5,589,012 | A | 12/1996 | Hobby et al. | |
| 5,618,359 | A | 4/1997 | Lin et al. | |
| 5,711,363 | A | 1/1998 | Scruggs et al. | |
| 5,735,975 | A | 4/1998 | Lin et al. | |
| 6,021,840 | A | 2/2000 | Colvin | |
| 6,325,868 | B1 | 12/2001 | Kim et al. | |
| 6,491,592 | B2 * | 12/2002 | Cackett et al. | 473/342 |
| 6,771,490 | B2 * | 8/2004 | Peker et al. | 361/679 |
| 6,843,496 | B2 * | 1/2005 | Peker et al. | 280/610 |
| 6,887,586 | B2 * | 5/2005 | Peker et al. | 428/600 |
| 2001/0055995 | A1 | 12/2001 | Cackett et al. | |

FOREIGN PATENT DOCUMENTS

| | | | |
|---|---|---|---|
| GB | 2236325 | A | 4/1991 |
| JP | 61238423 | A | 10/1986 |
| JP | 2001303218 | | 10/2001 |
| JP | 2002045960 | A | 2/2002 |
| JP | 02002045960 | A | 2/2002 |

OTHER PUBLICATIONS

Author unknown, "Interbike Buyer Official Show Guide", 1995, 3 pages.

Brochure entitled ProCAST . . . not just for castings!, UES, Inc., 1 page.

Eshbach et al., "Section 12—Heat Transfer", Handbook of Engineering Fundamentals, 3d ed., 1975, pp. 1113-1119.

Inoue et al., "Bulky La-Al-TM (TM=Transition Metal) Amorphous Alloys with High Tensile Strength Produced by a High-Pressure Die Casting Method", 1993, Materials Transactions, JIM, vol. 34, No. 4, pp. 351-358.

Inoue et al., "Mg-Cu-Y Bulk Amorphous Alloys with High Tensile Strength Produced by a High-Pressure Die Casting Method", 1992, Materials Transactions, JIM, vol. 33, No. 10, pp. 937-945.

Kato et al., "Production of Bulk Amorphous $Mg_{85}Y_{10}Cu_5$ Alloy by Extrusion of Atomized Amorphous Powder", 1994, Materials Transactions, JIM, vol. 35, No. 2, pp. 125-129.

Kawamura et al., Full Strength Compacts by Extrusion of Glassy Metal Powder at the Supercooled Liquid State, Oct. 2, 1995, Appl. Phys. Lett., vol. 67, No. 14, pp. 2008-2010.

Lyman et al., Metals Handbook, Forging and Casting, 8th ed., 1970, vol. 5, pp. 285-291 and 300-306.

Polk et al., "The Effect of Oxygen Additions on the Properties of Amorphous Transition Metal Alloys", Source and date unknown, pp. 220-230.

* cited by examiner

INVESTMENT CASTING OF BULK-SOLIDIFYING AMORPHOUS ALLOYS

CROSS-REFERENCE TO RELATED APPLICATION

This application is a National Stage of International Application No. PCT/US2003/31156, filed Sep. 30, 2003, which claims the benefit of U.S. Provisional Application No. 60/415,149, filed Sep. 30, 2002.

FIELD OF THE INVENTION

The present invention relates to casting of bulk-solidifying amorphous alloys, and more particularly to investment casting of bulk-solidifying amorphous alloys and articles of bulk solidifying amorphous alloys made using such investment casting methods.

BACKGROUND OF THE INVENTION

Bulk-solidifying amorphous alloys are a recently discovered family of amorphous alloys, which can be cooled at substantially lower cooling rates, of about 500 K/sec or less, than conventional amorphous alloys while still retaining their amorphous atomic structure. As a result of this reduced cooling rate, these bulk-solidifying amorphous alloys can be produced in thicknesses of 1.0 mm or more, substantially thicker than conventional amorphous alloys, which require cooling rates of $10^5$ K/sec or more, and which can only be cast in thicknesses of about 0.020 mm. U.S. Pat. Nos. 5,288,344; 5,368,659; 5,618,359; and 5,735,975 (the disclosures of which are incorporated herein by reference) disclose such bulk-solidifying amorphous alloys.

Articles made from such bulk-solidifying amorphous alloys are generally produced by permanent mold casting, and more specifically in processes which utilize metallic molds. For example, U.S. Pat. Nos. 6,021,840 and 5,711,363 (the disclosures of which are incorporated herein by reference) describe such methods utilizing die-casting techniques. In the die-casting process a molten feedstock of a bulk-solidifying amorphous alloy composition is cast into a metallic mold cavity. In such a method the metallic mold mass provides the rapid cooling necessary to form the amorphous phase during solidification.

Generally, permanent mold casting is preferred over other techniques when using bulk-solidifying amorphous alloys because this method provides a relatively high cooling rate and a high production rate. However, there are cases where permanent mold casting has certain shortcomings and, as a result, cannot be generally applied. For example, a metallic mold needs to be machined to produce shaped articles of bulk-solidifying amorphous alloys. Machining such molds is not only time-consuming, but requires a substantial financial investment in order to address the various complexities in permanent mold casting. Furthermore, even slight changes in the geometry of the mold cavity may cause major difficulties and, as such, even subtle subsequent design changes generally require machining new molds causing lost time and increased costs. These shortcomings becomes particularly acute in developing new products and prototypes, and in cases where one-of-a-kind or small runs are desired. As such, machining a new mold for each shape becomes a cost-prohibitive factor and hinders the market penetration of bulk-solidifying amorphous alloys to the rapid developments in design change.

Another potential shortcoming of permanent mold casting is the detailed replication of mold features. As the molten feedstock is fed into the mold cavity, rapid cooling takes place, which accelerates solidification and impedes the flow of the viscous fluid into the intricate details of the mold cavity. The relatively cold surface of the mold cavity and the high thermal conductivity of the metallic mold material precludes any wetting of the molten alloy to the mold surface. This matter is especially pronounced in thin sections where the thickness of the article is less than about 2.0 mm.

Accordingly, a need exists for an improved casting method for bulk-solidifying amorphous alloys, which will allow for low cost tooling, and should allow rapid implementation of design changes and complete replication of mold features, while still allowing for the formation of articles having the desired amorphous phase properties.

SUMMARY OF THE INVENTION

The current invention is directed to a method of investment casting bulk-solidifying amorphous alloys, and the formation of articles of bulk-solidifying amorphous alloys made by such methods.

BRIEF DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

The current invention is directed to a method of investment casting bulk-solidifying amorphous alloys, and the formation of articles of bulk-solidifying amorphous alloys made by such methods.

Figure 1:
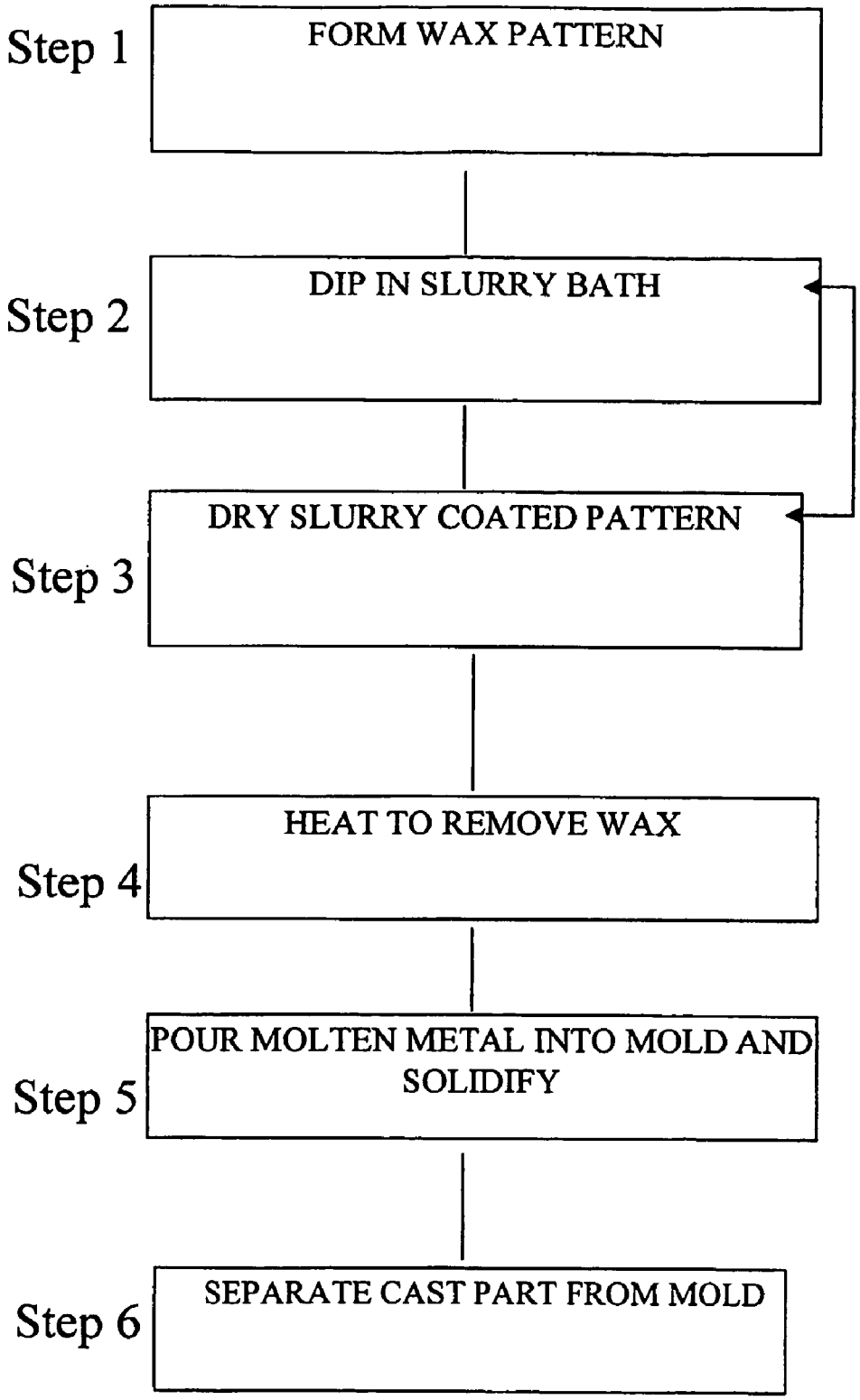
FIG. 1, is a flow diagram of a conventional method of forming molded articles of conventional alloys using investment casting.

Investment casting is a generally well established method for processing conventional metallic alloys. The general steps of investment casting are described in reference to the flow-chart shown in FIG. 1. First, a wax pattern is produced which imitates the shape of the desired final component.

(Step 1) Several of these wax patterns can be attached into a wax tree having a suitable network of gates and sprues to cast multiple parts at a time.

The wax pattern is then dipped into a suitable slurry bath and a coating is formed around the wax pattern. (Step 2) The coated slurry is then dried to form a rigid shell around the wax pattern. (Step 3) This step can be repeated several times to provide a sufficiently rigid and strong shell, which will act as a mold. (Optional Step 3a) In this step the composition and type of the slurry used can be varied in each coating step to provide optimum surface finish, strength, and rigidity. In an alternative embodiment, the investment shell can be prepared by quicker methods, such as by casting a pre-mixed slurry around the wax pattern, or alternatively, by submerging the wax pattern into a suitably sized slurry bath and letting the slurry bath solidify around the wax pattern.

The wax is then melted and burned out to leave a clean investment shell with cavities having the shape of the desired components and gates and sprues for multiple cavity patterns. (Step 4)

Then, the molten metal is introduced into the investment shell and left to solidify to form the shape of the cavities. (Step 5) In this step it is a common practice to heat the investment shell to elevated temperatures (however, below the melting temperature of the metal and alloy) to delay the solidification of the metal and, as such, improve the fluidity of the melt and ultimately allow for more complete filling of the investment shell cavity.

Subsequent to the solidification, the investment shell is separated from the cast metal components by agitation or other mechanical methods. (Step 6) During this step the investment shell is destroyed and as such investment casting process, in principle, one mold is used for each cast component. Further, post-cast finishing processes may be employed to finish the cast components such as, for example, cleaning the surface from any reaction and/or residue remaining from the investment mold.

In such conventional investment casting processes, the molten metal is cooled rather slowly. This is necessary in order to preserve the fluidity of the molten metal longer and to reduce the accumulation of any thermal stresses.

Since it is generally desired to avoid superheating of the molten metal above its melting temperature, in order to avoid coarse and inferior grain-structure, the effect of the slow cooling rate of this method in improving the fluidity of the melt is crucial. Further, this conventional investment casting is generally carried out when more precise and intricate parts are desired and, as such, quenching during the investment casting is not desired as it will cause thermal stresses and distortions in those parts. Indeed, the high solidification shrinkage of conventional metals during solidification often causes the breakage of parts during fast cooling of such intricate articles. In addition, thermal shock and high thermal stresses may also cause the investment shell to breaks and loose its integrity.

Accordingly, the prior art of investment casting is geared towards slow cooling of the molten metal rather than fast cooling or quenching. As a result, heating of the investment shell to elevated temperatures and the use of thick investment shells (up to 10 mm or more) are commonly practiced to subdue the cooling rate during the investment casting process.

Bulk-solidifying amorphous alloys are a recently discovered family of amorphous alloys, which can be cooled at substantially lower cooling rates, of about 500 K/sec or less, than conventional alloys, while still retaining their amorphous atomic structure. As such, these alloys can be produced in thicknesses of 1.0 mm or more, substantially thicker than conventional amorphous alloys, which are typically limited to articles having thicknesses of about 0.020 mm, and which require cooling rates of $10^5$ K/sec or more. U.S. Pat. Nos. 5,288,344; 5,368,659; 5,618,359; and 5,735,975 (the disclosures o which are incorporated herein by reference) disclose such bulk-solidifying amorphous alloys.

Although any bulk-solidifying amorphous alloys can be used in the present invention, one exemplary family of bulk-solidifying amorphous alloys can be described by the molecular formula $(Zr,Ti)_a(Ni,Cu,Fe)_b(Be,Al,Si,B)_c$, where a is in the range of from about 30 to 75, b is in the range of from about 5 to 60, and c in the range of from about 0 to 50 in atomic percentages. Furthermore, these alloys can accommodate substantial amounts of other transition metals up to about 20% atomic, and more. Although any transition metal may be included, preferably these metals include Nb, Cr, V, and Co. For example, a preferred alloy family is $(Zr,Ti)_a(Ni,Cu)_b(Be)_c$, where a is in the range of from about 40 to 75, b is in the range of from about 5 to 50, and c in the range of from about 5 to 50 in atomic percentages. Still, a more preferred composition is $(Zr,Ti)_a(Ni,Cu)_b(Be)_c$, where a is in the range of from about 45 to 65, b is in the range of from about 7.5 to 35, and c in the range of from about 10 to 37.5 in atomic percentages. Finally, another preferred alloy family is $(Zr)_a(Nb,Ti)_b(Ni,Cu)_c(Al)_d$, where a is in the range of from about 45 to 65, b is in the range of from 0 to 10, c is in the range of from about 20 to 40 and d in the range of from about 7.5 to 15 in atomic percentages.

These Zr-based bulk-solidifying amorphous alloys can sustain strains up to about 1.5% or more and generally around about 1.8% without any permanent deformation or breakage. Further, they have high fracture toughness of about 10 ksi-sqrt(in) (sqrt: square root) or more, and preferably about 20 ksi sqrt(in) or more. Also, these alloys have high hardness values of about 4 GPa or more, and preferably about 5.5 GPa or more. The yield strength of these bulk solidifying alloys range from about 1.6 GPa and reach up to about 2 GPa and more, exceeding the current state of titanium-based alloys.

Another set of bulk-solidifying amorphous alloys are compositions based on ferrous metals (Fe, Ni, Co). Examples of such compositions are disclosed in U.S. Pat. No. 6,325,868, (A. Inoue et. al., Appl. Phys. Lett., Volume 71, p 464 (1997)), (Shen et. al., Mater. Trans., JIM, Volume 42, p 2136 (2001)), and Japanese patent application 2000126277 (Publ. #.2001303218 A). (The disclosures of which are incorporated herein by reference.) One exemplary composition of such alloys is $Fe_{72}Al_5Ga_2P_{11}C_6B_4$. Another exemplary composition of such alloys is $Fe_{72}Al_7Zr_{10}Mo_5W_2B_{15}$. Although, these alloy compositions are not processable to the degree of the Zr-base alloy systems, they can still be processed in thicknesses of around 1.0 mm or more, which is sufficient to be utilized in specific embodiments of the current invention. Similarly, these alloys have elastic strain limits of higher than about 1.2%, and generally around about 1.8%. The yield strength of these ferrous-based bulk-solidifying amorphous alloys is also higher, ranging from about 2.5 GPa to about 4 GPa or more, making them particularly attractive. Ferrous metal-base bulk amorphous alloys also very high yield hardness ranging from about 7.5 GPA to about 12 GPa.

Although relatively pure amorphous phase bulk-solidifying amorphous alloys are discussed above, it is possible to use bulk-solidifying amorphous alloys including crystalline precipitates in the current invention. In general, crystalline precipitates in bulk-solidifying amorphous alloys are highly detrimental to their properties, especially to the toughness and strength of such alloys, and, as such, it is generally preferred to keep these precipitates to as small a volume fraction as possible. However, there are ductile crystalline phases, which precipitate in-situ during the processing of bulk-solidifying amorphous alloys, which are indeed beneficial to the properties of bulk-solidifying amorphous alloys, and particularly to the toughness and ductility of such alloys. Such bulk-solidifying amorphous alloys comprising such beneficial precipitates are also included in the current invention. One exemplary case is disclosed in (C. C. Hays et. al, Physical Review Letters, Vol. 84, p 2901, 2000) (the disclosure of which is incorporated herein by reference). This alloy has an elastic strain limit of about 1.8% or more and a yield strength of about 1.4 GPa and more, depending on the specific microstructure of the crystalline precipitates.

The investment casting process has not yet been successfully applied to the production of these bulk-solidifying amorphous alloys. The main issue with the adaptation of investment casting to the production of bulk-solidification amorphous alloys is the ability to employ sufficient cooling rates from the melting temperatures of bulk-solidifying amorphous alloys to down below the glass transition temperatures of bulk-solidifying amorphous alloys. Another significant issue is the reaction of the molten alloy with the investment mold or residues left behind in the investment mold. Further, the relatively porous structure of the investment mold hinders the release of reactive gases (such as oxygen, moisture) from the mold surface, which subsequently reacts with molten alloy and degrades the surface finish of the metallic cast components. These last two issues become especially prominent with reactive bulk-solidifying amorphous alloys and compositions sensitive to oxidation such as in the case of Zr—Ti base alloys.

The current invention is directed to novel methods to apply the investment casting process suitably to the production of bulk-solidifying amorphous alloys and methods to identify bulk-solidifying amorphous alloys suitable for such investment casting.

The main steps of investment casting of bulk solidifying amorphous alloys are shown in the flow-chart provided in FIG. 2, and provided in the following list:

1) Providing a suitable investment mold having a cavity (or cavities) with the shape of the desired component(s) (Step 1);
2) Providing a feedstock of bulk solidifying amorphous alloy (Step 2);
3) Heating the feedstock of the alloy above the melting temperature (Step 3);
4) Introducing the molten alloy into the cavity of the investment mold and filling of the cavities of the investment mold with the molten bulk-solidifying amorphous alloy (Step 4);
5) Bringing the filled investment mold into contact with a quenching medium (Step 5);
6) Separating the investment mold from the metallic cast component (Step 6);
7) (Optional) Keeping the metallic cast component in contact with a quenching medium until the whole part is cooled to well-below glass transition temperature (Step 7).

Figure 2:
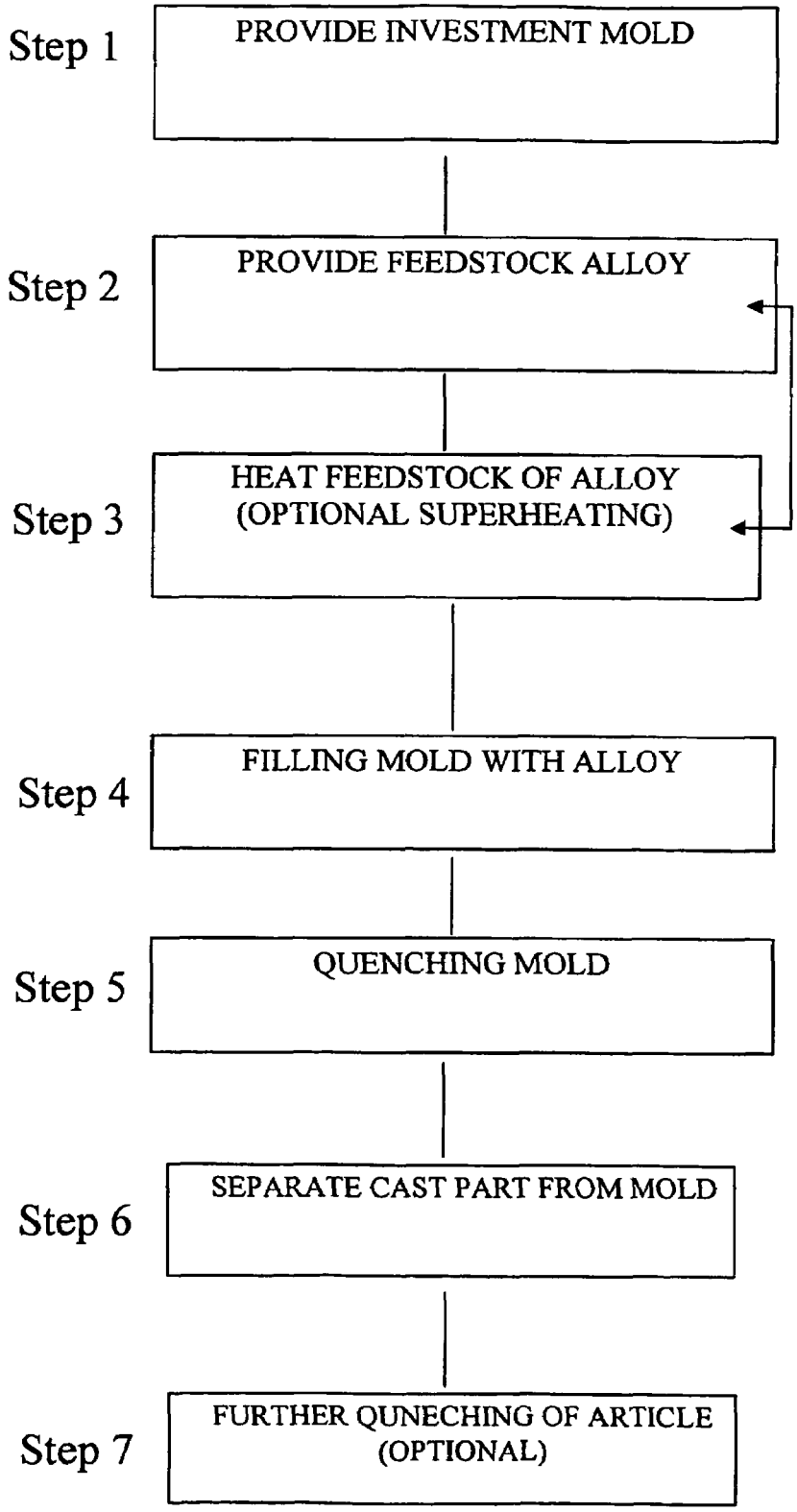
FIG. 2, is a flow diagram of a method of forming molded articles of bulk-solidifying amorphous alloys according to the present invention using investment casting.

As shown in FIG. 2, and described above, there are several additional steps and considerations in the investment casting of bulk-solidifying amorphous alloys. First, in Step 3, the provided feedstock of bulk-solidifying amorphous alloy is heated above the melting temperature, and preferable with a substantial superheating. It should be noted that the initial feedstock material does not need to have an amorphous phase.

In one preferred embodiment, superheating the feedstock to about 100° C. above the melting temperature is utilized. In another embodiment, superheating to about 200° C. or more is employed. Such superheating is generally not detrimental to the physical properties of bulk-solidifying amorphous alloys (unlike conventional crystalline metals) and can substantially enhance the fluidity of the alloy and improve cavity-filling, precluding a need for heating the investment shell to elevated temperatures. However, in cases where heat extraction is limited, or a larger amount of heat needs to be extracted due to overall part dimensions, superheating can be decreased to obtain a sufficient cooling rate to form the amorphous phase.

In conventional investment casting, the investment shell is preferably heated up to substantially elevated temperatures. As shown in Step 4, this is not necessarily preferred for investment casting of bulk-solidifying amorphous alloys. For example, in order to enhance the cooling rate, the heating of the investment shell is preferred to have a thickness of about 5.0 mm or lower, and more preferably 3.0 mm or lower. Even though, heating the investment shell can aid the release of trapped gas and humidity just before the introduction of molten metal, the heating of the investment shell should be limited to temperatures around the glass transition rather than close to the melting temperatures of these alloys. This becomes particularly important for the case of Zr—Ti based alloys, which may react with the investment shell and degrade the surface quality of the casting. To prevent this preferably the heating of the bulk amorphous metal is carried out under inert atmosphere or partial vacuum or full vacuum.

Figure 3A:
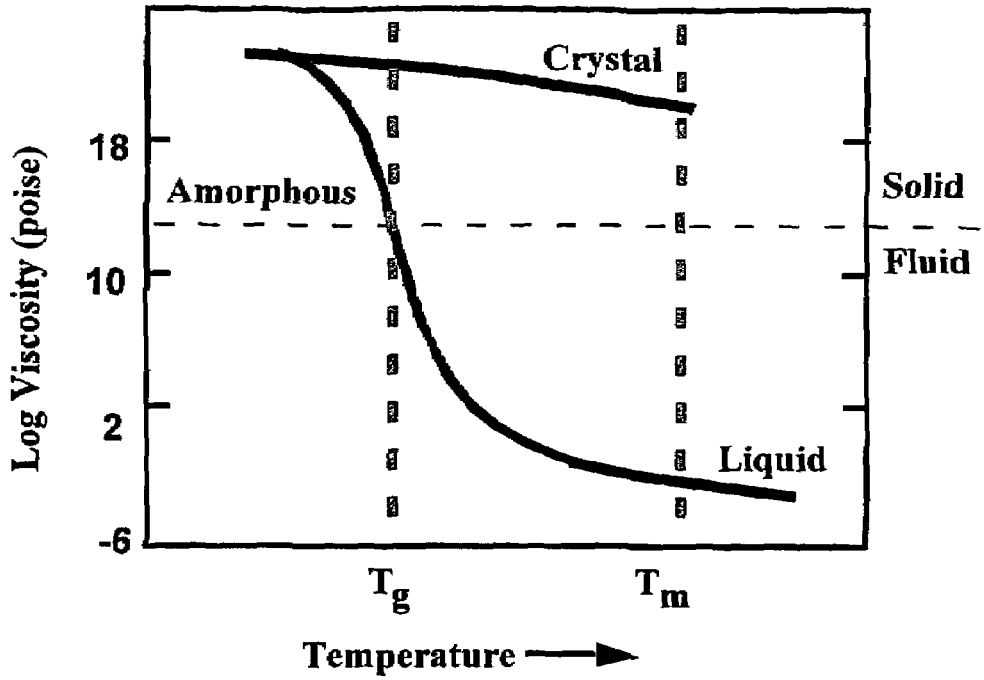
FIG. 3*a,* is a graphical depiction of the solidification properties of bulk amorphous alloys according to the present invention.
Figure 3B:
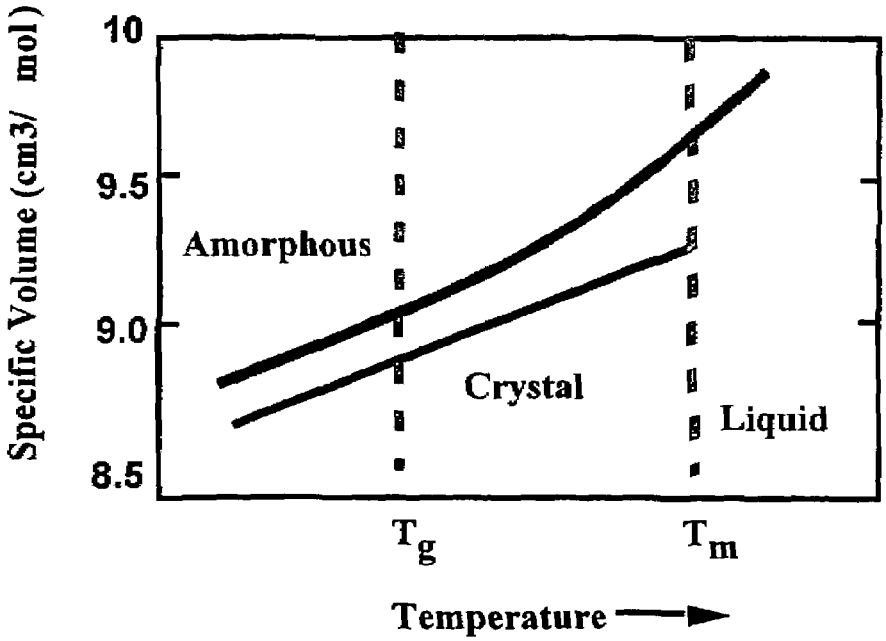
FIG. 3*b,* is a graphical depiction of the solidification properties of bulk amorphous alloys according to the present invention.

A surprising benefit of using such bulk-solidifying amorphous alloys is that they solidify rather gradually in a continuous manner unlike conventional metals which solidify in a discontinuous manner. This is illustrated graphically by FIGS. 3*a* and 3*b* which show the change in viscosity and volume, respectively, of a bulk-solidifying amorphous alloy as it solidifies. As detailed in the Figures, bulk-solidifying amorphous alloys retain their fluidity from above the melting temperature down to the glass transition temperature due to the lack of a first order phase transition. This is in direct contrast conventional metals and alloys. Since, bulk amorphous alloys retain their fluidity they do not accumulate significant stress from their casting temperatures down to below the glass transition temperature in the investment mold, and as such the premature cracking of the investment mold is avoided. Indeed, the cracking of the investment shell is preferred after the temperature of the outer portion of the cast part is reduced to temperatures below glass transition temperature in order to aid the cooling rate. Accordingly, the investment mold does not need to be heated to elevated temperatures as in the investment casting procedure of conventional alloys. This allows the use of a faster quenching rate than is possible in a typical conventional investment casting. Furthermore, the heat released during cooling of the bulk solidifying amorphous alloy is rather gradual and lacks the sudden heat release from the latent heat of fusion in conventional materials. This characteristic also allows both a relatively cooler (with respect to melt temperature) investment mold and the ability to quench the investment mold down to temperatures below the glass transition temperature of the bulk-solidifying amorphous alloy. In short, it has been surprisingly found that the ability of bulk-solidifying amorphous alloys to retain their fluidity down to glass transition temperatures, which are much lower than the casting temperatures, allows for the use of quenching of the investment mold in an investment casting process.

To the extent that the investment shell is heated, it is preferably heated up to a suitable temperature under an inert atmosphere and preferably in vacuum in order to release any trapped gas and humidity on the inner cavity surfaces of investment shell. The effect of such gases becomes highly detrimental not only for the surface quality of castings, but in order to obtain a high cooling rate as such trapped gases can form bubbles and impede the heat transfer from the molten metal to the investment shell.

The introduction of the molten alloy into the cavity of the investment mold and the filling of the cavities of the investment mold can be carried out with a variety of methods. A particularly preferred embodiment is where the introduction of the molten metal is carried out when the investment mold is under vacuum or in-situ pulling of vacuum. The forces used to introduce the molten metal can also take several forms such as gravity feeding, centrifugal forcing, vacuum suction/assist, or external pressure application such as by use of inert gas. In one preferred embodiment, the introduction of the molten metal is carried out in the form of counter-gravity casting. In another embodiment, the introduction of molten metal is carried out by centrifugal forces.

After the investment cavity is filled, the investment mold is brought into contact with a quenching media (Step 5). This can be carried out by submerging the investment shell in a fluidized bed or in a liquid bath. After the initial quenching, the investment can be separated from the cast component either by agitation or other means such as mechanical forces (Step 6).

The cast metallic components can be retained in the quenching media or optionally can be transferred into another quenching media to enhance the cooling rate in the bulk of the cast component (Step 7). This step is especially preferred for casting components of larger dimensions, such as ones with outer dimensions of larger than about 30 mm or thicknesses of about 5 mm or higher.

Although several new steps are provided in the above method, the investment shell itself can be prepared in accordance with the above mentioned conventional methods utilizing conventional investment materials. However, given the importance of heat transfer to the investment casting of bulk-solidifying amorphous alloys, in one preferred embodiment, the thickness of the investment shell is desired to be less than about 5.0 mm and more preferably less than about 3.0 mm. For smaller casting parts, with outer dimensions less than about 10 mm, still thinner investment shells of less than about 2.0 mm, can be utilized. These thin walls help speed the rather progressive heat release during solidification of bulk-solidifying amorphous alloys (unlike conventional crystalline metals, which release heat of fusion rather fast during a narrow temperature window).

Although any suitable casting mold design may be used, it should be noted that some part geometries are particularly preferred for investment casting of bulk-solidifying amorphous alloys. Particularly preferred are part geometries for hollow objects, and geometries of high aspect ratios. These geometries can be defined by the following "defining ratio":

Defining Ratio=outer dimension:thickness

For example, for hollow objects, the ratio of outer dimension to the thickness of the part becomes the defining ratio. For example, in the case of a tube-like component, the ratio of the outside diameter (OD) to the wall thickness (t) will be the defining ratio. In another example of a semi-spherical or dome-like component, the diameter of the sphere to the wall thickness becomes the defining ratio. For high-aspect ratio objects, the ratio of the larger dimension to the smallest dimension will be the defining ratio. For example, in the case of a disc-like object, the diameter of the disc to the thickness of the disc will be the defining ratio. It should be understood that the above definitions can be extended and applied to the more complex part geometries in the spirit of the current invention, where typical cross-sections of these complex objects can be utilized to reach the defining ratios.

In one preferred embodiment, a superheating of about 100° C. above the melting temperature is utilized. In another embodiment, a superheating of about 200° C. or more superheating is employed To prevent this preferably the heating of the bulk amorphous metal is carried under inert atmosphere or partial vacuum or full vacuum.

In one embodiment, the defining ratio is larger than about 5. In another embodiment, the defining ratio can be larger than about 10. In another embodiment, the defining ratio can be larger than about 20. In one preferred embodiment, the defining ratio is larger than about 5 and the outer dimension is smaller than about 10 mm. In another preferred embodiment, the defining ratio is larger than about 10 and the outer dimension is less than about 30 mm. In still another preferred embodiment, the defining ratio is larger than about 20 and the outer dimension is less than about 60 mm.

Bulk-solidifying amorphous alloys generally have much lower melting temperatures than the melting temperatures of its constituents. This is especially true when compared to the weighted averages of the constituent melting temperatures. Although it may be argued that amorphous alloys do not experience a melting phenomenon in the same manner as a crystalline material, it is convenient to describe a "melting point" at which the viscosity of the material is so low that, to the observer, it behaves as a melted solid. The melting point or melting temperature of the amorphous metal may be considered as the temperature at which the viscosity of the material falls below about $10^2$ poise. Alternatively, the melting temperature of the crystalline phases of the bulk-solidifying amorphous alloy composition can be taken as the melting temperature of the amorphous alloy. For example Zr—Ti based bulk-solidifying amorphous alloys typically have melting temperatures of about 800° C. or less.

Figure 4:
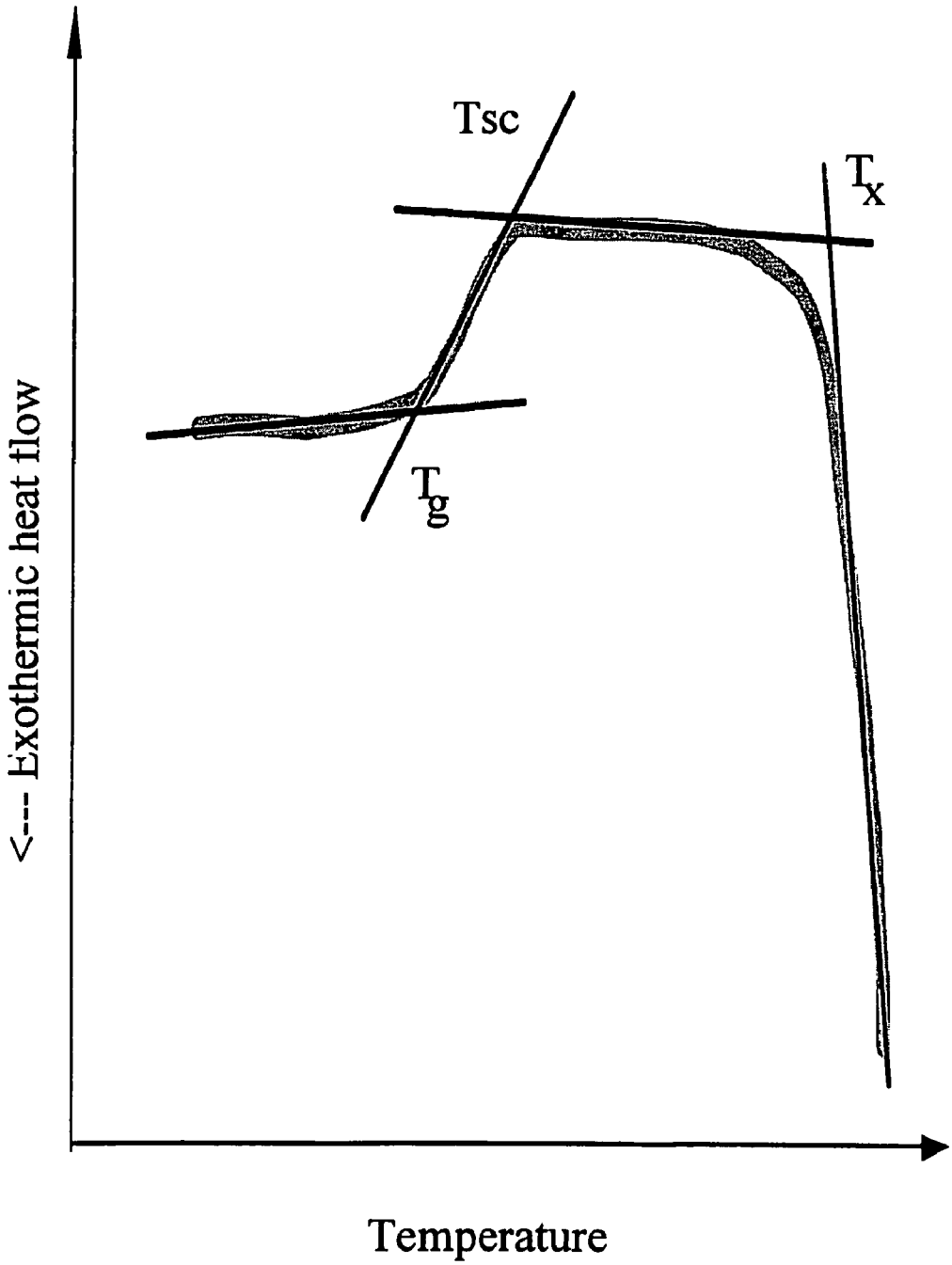
FIG. 4, is a graphical representation of the phase change properties of an exemplary embodiment of the bulk-solidifying amorphous alloys according to the present invention.

Although any suitable bulk-solidifying amorphous alloys can be utilized in one or another form of the invention, ones with lower critical cooling rates are preferred. In one preferred embodiment of the invention, a bulk-solidifying amorphous alloy with a critical cooling rate of less than about 50° C./sec is used. In a still more preferred embodiment of the invention, a bulk-solidifying amorphous alloy with a critical cooling rate of less than about 5° C./sec is used. A particularly preferred characteristic of the bulk-solidifying amorphous alloy is the enhanced stability against crystallization at temperatures above the glass transition temperature, Tg, but at temperatures substantially below the melting temperature. This characteristic can be defined by ΔTsc (ΔT-super-cooled liquid region is defined as the difference of Tx and Tsc, as shown in FIG. 4). The bulk-solidifying amorphous alloy in accordance with the current invention preferably has a ΔTsc (supercooled liquid region) of more than about 30° C., and preferably a ΔTsc of more than about 60° C., and still most preferably a ΔTsc of about 90° C. or more.

For the purposes of this disclosure, Tg, Tsc and Tx are determined from standard DSC (Differential Scanning Calorimetry) scans at 20° C. Tg is defined as the onset temperature of glass transition, Tsc is defined as the onset temperature of super-cooled liquid region, and Tx is defined as the onset temperature of crystallization. ΔTsc is defined as the difference between Tx and Tsc. All the temperature units are in ° C. A diagram of a typical phase transition curve for an exemplary bulk-solidifying amorphous alloy is shown in FIG. 4.

A high value of ΔTsc becomes crucial as the effective cooling rate of the molten metal in such a disclosed investment casting process decreases rather more dramatically at temperatures substantially below the melting temperatures than generally experienced in typical metallic mold casting process.

A particularly preferred bulk-solidifying amorphous alloy composition is one having a single crystallization in a smaller temperature range and at a high peak transformation rate in a typical DSC heating scan.

In a typical DSC heating scan of bulk solidifying amorphous alloys, crystallization can take in one or more steps. The preferred bulk-solidifying amorphous alloys are ones with a single crystallization step in a typical DSC heating scan. However, most of the bulk solidifying amorphous alloys crystallize in more than one step in a typical DSC heating scan. (For the purposes of this disclosure all the DSC heating scans are carried out at the rate of 20° C./min and all the extracted values are from DSC scans at 20° C./min. Other heating rates such as 40° C./min, or 10° C./min can also be utilized while basic physics of this disclosure still remaining intact).

Figure 5:
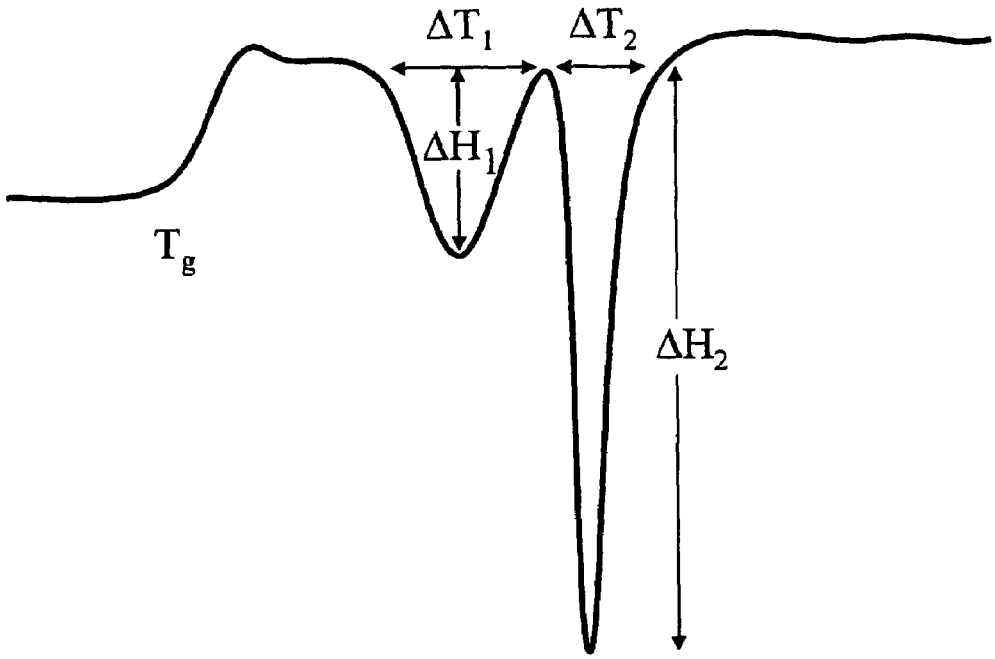
FIG. 5, is a graphical representation of the crystallization properties of an exemplary embodiment of the bulk-solidifying amorphous alloys according to the present invention.

Shown schematically in FIG. 5 is one type of crystallization behavior of a bulk-solidifying amorphous alloy in a typical DSC scan such as at 20° C./min heating rate. The crystallization happens to occur over in two steps. The first crystallization step occurs over a relatively large temperature range at a relatively slower peak transformation rate, whereas the second crystallization occurs over a smaller temperature range than the first one and at a much faster peak transformation rate than the first one. Here ΔT1 and ΔT2 are defined as the temperature ranges over which the first and second crystallization steps proceed, respectively. ΔT1 and ΔT2 can be calculated by taking the difference between the onset of the crystallization and "outset" of the crystallization which are calculated in a similar manner for Tx by taking the cross section point of preceding and following trend lines as depicted in FIG. 5. The enthalpy of crystallization ΔH1 and ΔH2 can then be calculated by calculating the peak heat flow value compared to the baseline heat flow. (It should be noted that although the absolute values of ΔT1, ΔT2, ΔH1 and ΔH2 depend on the specific DSC set-up and the size of the test specimens used, the relative scaling (i.e. ΔT1 vs ΔT2) should remain intact).

Figure 6:
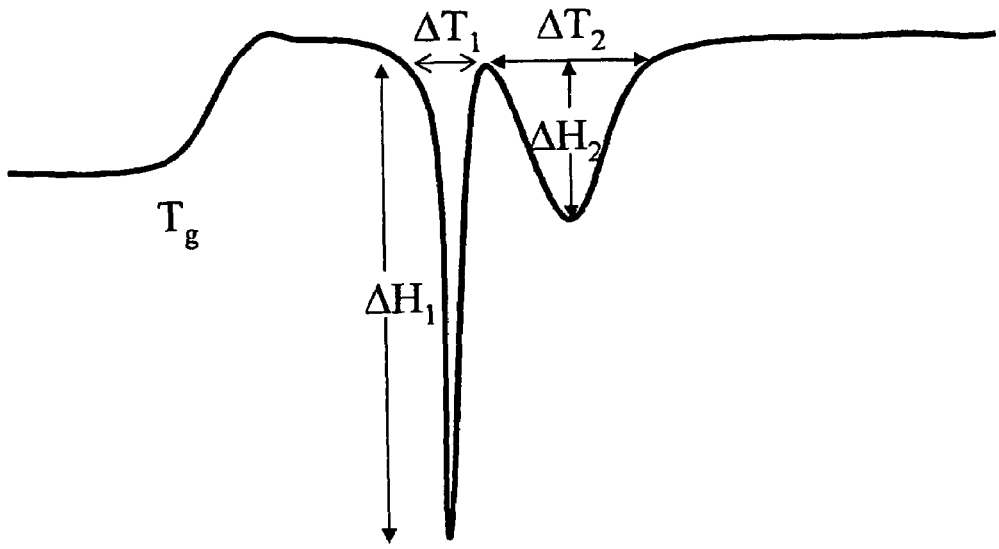
FIG. 6, is a graphical representation of the crystallization properties of another exemplary embodiment of the bulk-solidifying amorphous alloys according to the present invention.

Shown schematically in FIG. 6 is another type of crystallization behavior of a bulk-solidifying amorphous alloy in a typical DSC scan such as at a heating rate of 20° C./min. In this figures, the crystallization again occurs in two steps, however, the first crystallization step occurs over a relatively small temperature range at a relatively faster peak transformation rate, whereas the second crystallization occurs over a larger temperature range than the first one and at a much slower peak transformation rate than the first one. Here ΔT1, ΔT2, ΔH1 and ΔH2 are defined and calculated as above.

It should be noted that although, only two crystallization steps are shown above, the crystallization behavior of some bulk solidifying amorphous alloys can take place in more than two steps. In such cases, the subsequent ΔT3, ΔT4 . . . and ΔH3, ΔH4 . . . can also be defined. In such cases, the preferred compositions of bulk amorphous alloys are ones where ΔH1 is the largest of ΔH1, ΔH2, . . . ΔHN.

In all such cases, a sharpness ratio can be defined for each crystallization step by ΔHN/ΔTN. The higher ΔH1/ΔT1 compared to the other ΔHN/ΔTN, the more preferred the alloy composition. Thus, for the two cases discussed above, the bulk-solidifying amorphous alloy with the second crystallization behavior (FIG. 6) is the preferred alloy for investment casting, and especially with larger section thickness.

Accordingly, from a given family of bulk solidifying amorphous alloys, the preferred composition is with the highest ΔH1/ΔT1 compared to other crystallization steps. For example, a preferred alloy composition has ΔH1/ΔT1>2.0*ΔH2/ΔT2. Still more preferable is ΔH1/ΔT1>4.0*ΔH2/ΔT2.

Although specific embodiments are disclosed herein, it is expected that persons skilled in the art can and will design alternative investment casting methods that are within the scope of the following description either literally or under the Doctrine of Equivalents.

What is claimed is:

1. A method of investment casting bulk solidifying amorphous alloys comprising:

providing an investment mold having at least one cavity;

providing a feedstock of bulk solidifying amorphous alloy, wherein the bulk solidifying amorphous alloy has a ΔTsc of more than 60° C.;

heating the feedstock of the bulk solidifying amorphous alloy to a temperature above the melting temperature of the bulk solidifying amorphous alloy to form a molten bulk solidifying amorphous alloy;

introducing a sufficient quantity of the molten bulk solidifying amorphous alloy into the cavity of the investment mold to fill the cavity of the investment mold with molten bulk solidifying amorphous alloy, wherein during the introduction the investment mold is heated to a temperature around the glass transition temperature of the bulk solidifying amorphous alloy;

quenching the filled investment mold in a quenching medium to form a cast component of the bulk solidifying amorphous alloy, and wherein the filled investment mold is kept in contact with the quenching medium until the entirety of the cast component is cooled to below the glass transition temperature of the bulk solidifying amorphous alloy;

separating the investment mold from the cast component; and wherein the bulk-solidifying amorphous alloy has at least one crystallization step, the at least one crystallization step being defined by a temperature range ($\Delta T_n$) over which the crystallization step occurs and an enthalpy ($\Delta H_n$) defining the difference in heat flow during the crystallization step, and wherein the enthalpy of the first crystallization step ($\Delta H_1$) is larger than the enthalpies of any subsequent crystallization steps.

2. The method described in claim 1, wherein the bulk solidifying amorphous alloy has a ΔTsc of more than 90° C.

3. The method described in claim 1, wherein the investment mold is separated from the cast component after the temperature at an outer portion of the cast component is reduced below the glass transition temperature of the bulk solidifying amorphous alloy.

4. The method described in claim 1, wherein the thickness of the investment mold is less than 3.0 mm.

5. The method described in claim 1, wherein heating the feedstock includes superheating the feedstock to a temperature about 100° C. above the melting temperature of the bulk-solidifying amorphous alloy.

6. The method described in claim 1, wherein the heating of the feedstock is carried out under one of either an inert atmosphere or vacuum.

7. The method described in claim 1, wherein the bulk-solidifying amorphous alloy has a critical cooling rate of less than about 50° C./sec.

8. The method described in claim 1, wherein the bulk-solidifying amorphous alloy has a critical cooling rate of less than about 5° C./sec.

9. The method described in claim 1, wherein the bulk-solidifying amorphous alloy has a single crystallization step.

10. The method described in claim 1, wherein the bulk-solidifying amorphous alloy has at least two crystallization.

11. The method described in claim 1, wherein the bulk-solidifying amorphous alloy has a sharpness ratio for each crystallization step defined by the equation $\Delta H_n/\Delta T_n$, and wherein the sharpness ratio of the first crystallization step $(\Delta H_n/\Delta T_1)$ is larger than the sharpness ratios of the subsequent crystallization steps.

12. The method described in claim 1, wherein the bulk-solidifying amorphous alloy has a sharpness ratio for each crystallization step defined by the equation $\Delta H_n/\Delta T_n$, and wherein the sharpness ratio of the first crystallization step $(\Delta H_1/\Delta T_1)$ is at least twice as large as the sharpness ratio of the subsequent crystallization step.

13. The method described in claim 1, wherein the bulk-solidifying amorphous alloy has a sharpness ratio for each crystallization step defined by the equation $\Delta H_n/\Delta T_n$, and wherein the sharpness ratio of the first crystallization step $(\Delta H_1/\Delta T_1)$ is at least four times as large as the sharpness ratio of the subsequent crystallization step.

14. The method described in claim 1, wherein introducing the molten bulk solidifying amorphous alloy is carried out under vacuum.

15. The method described in claim 1, wherein introducing the molten bulk-solidifying amorphous alloy comprises a process selected from the group consisting of gravity feeding, centrifugal forcing, vacuum suction/assist, external pressure application, and counter-gravity casting.

* * * * *

UNITED STATES PATENT AND TRADEMARK OFFICE

CERTIFICATE OF CORRECTION

PATENT NO. : 7,293,599 B2
APPLICATION NO. : 10/529585
DATED : November 13, 2007
INVENTOR(S) : Atakan Peker et al.

It is certified that error appears in the above-identified patent and that said Letters Patent is hereby corrected as shown below:

In column 11, Claim 10, line 15, after "crystallization" insert --steps--

Signed and Sealed this

Eighteenth Day of May, 2010

David J. Kappos

David J. Kappos
*Director of the United States Patent and Trademark Office*